US005513621A

United States Patent [19]

Vanskiver

[11] Patent Number: 5,513,621

[45] Date of Patent: May 7, 1996

[54] PROTECTIVE DEVICE FOR HUNTING BOWS

[76] Inventor: Bernard S. Vanskiver, 534 New Hampshire Ave., Norfolk, Va. 23508

[21] Appl. No.: 255,640

[22] Filed: Jun. 9, 1994

[51] Int. Cl.[6] ..... F41B 5/14

[52] U.S. Cl. ..... 124/86; 150/154

[58] Field of Search ..... 124/1, 23.1, 25.6, 124/86, 88; 150/154, 160, 163

[56] References Cited

U.S. PATENT DOCUMENTS

| | | | |
|---|---|---|---|
| 2,904,128 | 9/1959 | Boham et al. | 150/154 X |
| 2,968,300 | 1/1961 | Allen | 150/154 X |
| 3,207,145 | 9/1965 | Browning et al. | 124/23.1 |
| 3,253,587 | 5/1966 | Pearson | 124/23.1 |
| 4,377,152 | 3/1983 | Saunders | 124/88 |
| 4,671,249 | 6/1987 | Troncoso | 124/24.1 |
| 4,846,140 | 7/1989 | DiMartino | 248/360 |
| 4,979,488 | 12/1990 | Fenton et al. | 124/25.6 |

*Primary Examiner*—John A. Ricci
*Attorney, Agent, or Firm*—Henderson & Sturm

[57] ABSTRACT

A protective device (10) for the ends (101) (102) of a bow (100) which also doubles as a bow sling; wherein the device (10) comprises a pair of padded pouch members (20) dimensioned to receive the opposite ends (101) (102) of a bow (100); and, an adjustable strap member (40) for operatively connecting the pouch members (20) together.

12 Claims, 1 Drawing Sheet

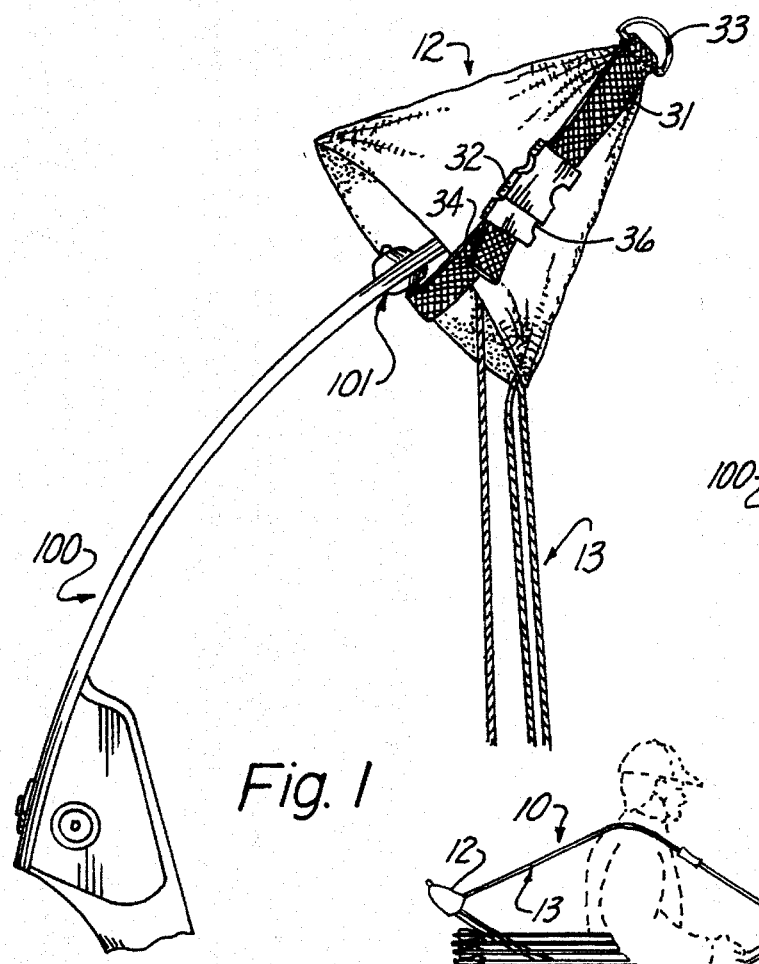
Fig. 1
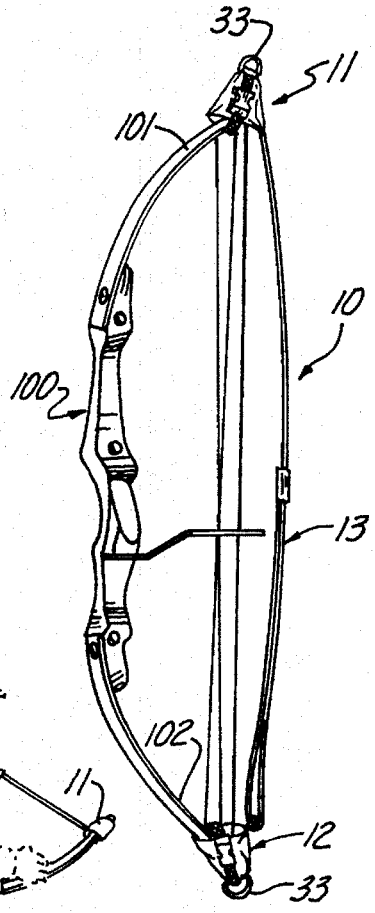
Fig. 4
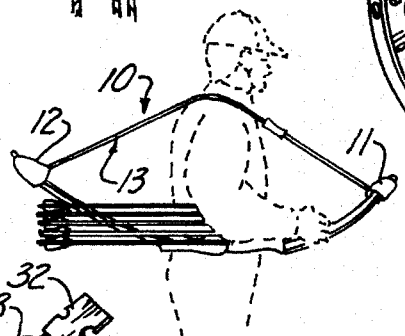
Fig. 5
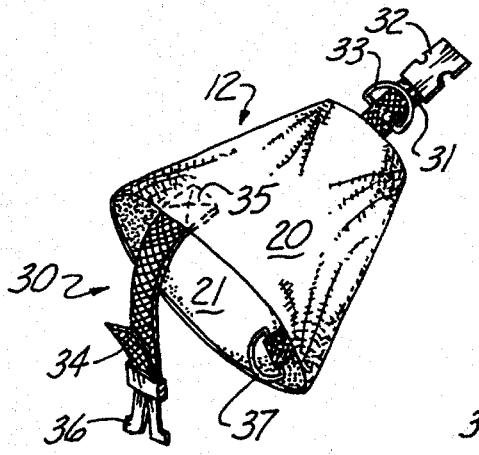
Fig. 2
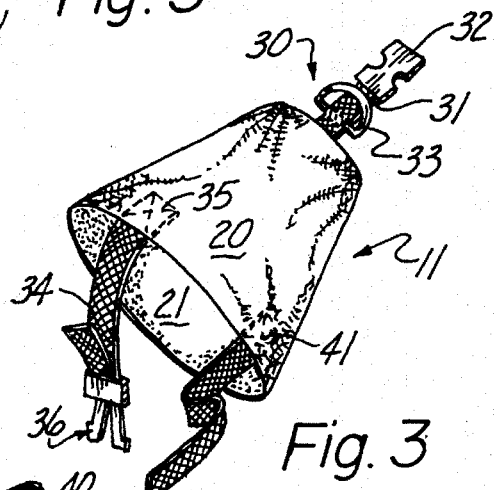
Fig. 3
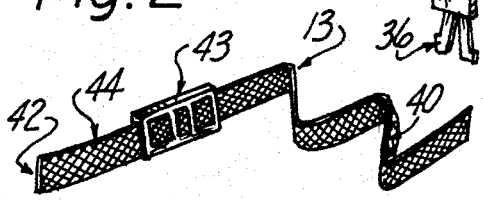

PROTECTIVE DEVICE FOR HUNTING BOWS

TECHNICAL FIELD

The present invention relates to the field of archery in general, and in particular to a device to protect the ends of a hunting bow while also serving as a sling to transport the bow while hunting.

BACKGROUND ART

This invention was the subject matter of Document Disclosure Program Registration No. 341412 which was filed in the United States Patent and Trademark Office on Oct. 22, 1993.

As can be seen by reference to the following U.S. Pat. Nos. 4,979,488; 4,846,140; 4,671,249; and 4,377,152; the prior art is replete with myriad and diverse archery related accessories that are intended to protect and/or support different structural components of a hunting bow. .

While all of the aforementioned prior art constructions are more than adequate for the basic purpose and function for which they have been specifically designed, these patented devices are neither designed nor intended to serve the dual purpose and function that is provided by the subject matter of the present invention.

As any bowhunter is aware the ends of a hunting bow, be it the compound or stick variety, are the portions of a bow that are the most susceptible to damage; since in the instance of a conventional or "stick" bow, this is the thinnest portion of the bow; and, in the case of a compound bow, this is the area, where the cables pass over the pulleys or cam wheels which are mounted on needle bushings or axles.

In addition the majority of bowhunters also experience a certain amount of discomfort and/or fatigue after spending a full day of either carrying their bows in the open areas of the west or holding their bows in the tree stand type hunting which is more common east of the Mississippi River.

As a consequence of the foregoing situation, there has existed a longstanding need among all bowhunters for a new type of archery accessory that not only protects the ends of the hunting bow but also functions as a sling for transporting the bow; and, the provision of such a construction is a stated objective of the present invention.

DISCLOSURE OF THE INVENTION

Briefly stated, the protective device for hunting bows that forms the basis of the present invention comprises in general a pair of protective cover units that are attached to the opposite ends of an adjustable carrying strap unit.

In addition each of the protective cover units comprises a generally cone-shaped cover member that is dimensioned to fit over and surround one end of a hunting bow; and, further includes a releasable strap assembly for securing the cover member to the end of the bow, plus a D-ring element that can be employed to either lift or suspend the bow from either end.

As will be explained in greater detail further on in the specification, the protective device of this invention performs a variety of functions that will serve to make bowhunting and/or target shooting a more pleasurable experience for the archer while freeing their hands for other tasks such as horseback riding, glassing for game, posing for pictures with the hunting trophies, etc.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is an isolated detail view of a portion of the protective device of this invention covering one end of a hunting bow;

FIG. 2 is an isolated detail view of one of the protective cover units contemplated for use in this invention;

FIG. 3 is an isolated detail view of another of the protective cover units contemplated for use in this invention;

FIG. 4 is a perspective view of the protective device in its entirety installed on a bow; and, FIG. 5 is a perspective view showing the protective device being employed as a bow sling.

BEST MODE FOR CARRYING OUT THE INVENTION

As can be seen by reference to the drawings, and in particular to FIG. 4, the protective device for hunting bows that forms the basis of the present invention is designated generally by the reference numeral (10). The device (10) comprises in general: a pair of protective cover units (11) (12); and, and adjustable strap unit (13). These units will now be described in seriatim fashion.

As can best be seen by reference to FIGS. 2 and 3 each of the protective cover units (11) and (12) comprise a generally funnel shaped pouch member (20) having a protective padded interior (21) dimensioned to surround one end (101) or (102) of a hunting bow (100); and, further including a strap assembly (30) for releasably securing the pouch member (20) around a respective end (101) (102) of the bow (100).

Still referring to FIGS. 2 and 3, it can be seen that the strap assembly (30) comprises: a first generally short strap element (31) and further provided with a female Coupling element (32) disposed on its free end, plus a D-ring element (33) disposed intermediate its opposite ends; and, a second relatively long strap element (34) secured on one end (35) to the other end of the pouch member (20), and further provided on its free end with a male coupling element (36).

As can be seen in particularly reference to FIG. 3, in the preferred embodiment of this invention the adjustable strap unit (13) comprises an elongated strap member (40) having one end (41) fixedly secured to one of the pouch members (20); wherein, the other end (42) of the strap member (40) is provided with a buckle element (43) that captively engages the free end of the strap member (40) to form a loop (44) for reasons that will be explained presently.

Turning now to FIG. 2, it can be seen that in the preferred embodiment of the invention at least one of the pouch members (20) is further provided with a D-ring equipped tab element (37) which is dimensioned to receive a portion of, and be captively engaged within, the loop (44) on the elongated strap member (40), for the purpose of operatively attaching the protective cover units (11) and (12) to the opposite ends of the adjustable strap unit (13).

At this juncture it should be appreciated that despite the fact that the preferred embodiment discloses the adjustable strap unit (13) fixedly secured on one end of one of the cover units (11); this invention also contemplates an alternate embodiment (not shown), wherein both of the cover units (11) and (12) are provided with D-ring tab elements (37) and the adjustable strap unit (13) is provided with a pair of buckle elements (43) disposed proximate both of its ends for releasably engaging the tab elements (37) on both of the pouch members (20) to form the operative engagement between the cover units (11) and (12) and the adjustable strap unit (13).

Turning now to FIGS. 4 and 5, it can be seen that the D-ring elements (33) on each of the cover units (11) and (12) provide a means for suspending the bow (100) from either end, as well as providing an attachment means to allow the bow to be handled up into a tree stand. Furthermore, when the device (10) is used as a bow sling the archer or bowhunter can have both hands free for the purpose of glassing game, riding a horse, posing with hunting trophies etc.

It should also be appreciated at this juncture that the device (10) that forms the bases of this invention is equally effective from both a transport and protection standpoint for all types of hunting and target bows such as compounds, recurves and longbows.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A device for protecting the ends of both hunting and target bows; wherein the device comprises:

a pair of protective cover units wherein each cover unit includes a generally cone shaped padded pouch member dimensioned to loosely receive one end of a bow; and an adjustable strap unit including an elongated adjustable strap member operatively attached on opposite ends to the said pair of protective cover units.

2. The device as in claim 1; wherein, each of the pouch members are provided with a strap assembly including a pair of strap elements having one end attached to the pouch member and the other end provided with cooperating coupling elements; wherein, each strap assembly is used to secure each pouch member to opposite ends of said bow.

3. The device as in claim 1; wherein, at least one of the pouch members is provided with a D-ring equipped tab element wherein the tab element is dimensioned to receive a portion of said strap member.

4. The device as in claim 3; wherein, the adjustable strap member is further provided with a buckle element for forming a loop on one end of the strap member for captively engaging said D-ring equipped tab element.

5. The device as in claim 4; wherein, the other end of the adjustable strap member is fixedly secured to one of the pouch members.

6. A device for protecting the ends of a bow; wherein the device comprises:

a pair of protective cover units wherein each cover unit includes a generally funnel shaped padded pouch member dimensioned to receive one end of a bow; and an adjustable strap unit including an elongated adjustable strap member operatively attached on opposite ends to the said pair of protective cover units; wherein, at least one of the pouch members is provided with a tab element wherein the tab element is dimensioned to receive a portion of said strap member; wherein the adjustable strap member is further provided with a buckle element for forming a loop on one end of the strap member for captively engaging said tab element.

7. The device as in claim 6; wherein, the tab element is equipped with a D-ring.

8. The device as in claim 6; wherein, each of the pouch members are provided with a strap assembly including a pair of strap elements having one end attached to the pouch member and the other end provided with cooperating coupling elements; wherein, each strap assembly is used to secure each pouch member to opposite ends of said bow.

9. The device as in claim 6; wherein, the other end of the adjustable strap member is fixedly secured to one of the pouch members.

10. A device for protecting the ends of a bow having a bow string disposed between the upper and lower limbs of the bow wherein the device comprises:

a pair of protective cover units wherein each cover unit includes a generally cone shaped padded pouch member dimensioned to receive one end of a bow;

an adjustable strap unit including an elongated adjustable strap member operatively attached on opposite ends to the said pair of protective cover units; and, means associated with each of said pouch members for forming a closed loop on each end of the bow at a point intermediate the bow string and one of the bow limbs.

11. The device as in claim 10, wherein, said means comprises a strap assembly including a pair of strap elements having one end attached to a pouch member and the other end provided with cooperating coupling elements.

12. The device as in claim 11, wherein, one of said pair of strap elements is provided with a D-ring for suspending the bow from a suitable support.

* * * * *